US009426589B2

(12) United States Patent
Udesen

(10) Patent No.: US 9,426,589 B2
(45) Date of Patent: Aug. 23, 2016

(54) DETERMINATION OF INDIVIDUAL HRTFS

(71) Applicant: GN ReSound A/S, Ballerup (DK)

(72) Inventor: Jesper Udesen, Malov (DK)

(73) Assignee: GN ReSound A/S, Ballerup (DK)

( * ) Notice: Subject to any disclaimer, the term of this patent is extended or adjusted under 35 U.S.C. 154(b) by 229 days.

(21) Appl. No.: 13/949,134

(22) Filed: Jul. 23, 2013

(65) Prior Publication Data

US 2015/0010160 A1 Jan. 8, 2015

(30) Foreign Application Priority Data

Jul. 4, 2013 (DK) ..... 2013 70374
Jul. 4, 2013 (EP) ..... 13175052

(51) Int. Cl.
*H04R 25/00* (2006.01)
*H04S 1/00* (2006.01)

(52) U.S. Cl.
CPC ..... *H04R 25/70* (2013.01); *H04S 1/005* (2013.01); *H04S 2420/01* (2013.01)

(58) Field of Classification Search
CPC ..... H04S 2420/01; H04S 2400/01; H04S 2400/15; H04S 1/005; H04S 1/007; H04S 1/002; H04S 5/00; H04S 7/303; H04S 7/304; H04S 7/306; H04S 7/00; H04R 25/70
USPC ..... 381/23.1, 60, 1–18, 309
See application file for complete search history.

(56) References Cited

U.S. PATENT DOCUMENTS

| | | | | |
|---|---|---|---|---|
| 6,181,800 | B1 | 1/2001 | Lambrecht | |
| 2006/0274901 | A1* | 12/2006 | Terai et al. | 381/17 |
| 2008/0137870 | A1 | 6/2008 | Nicol et al. | |
| 2008/0306720 | A1* | 12/2008 | Nicol et al. | 703/13 |
| 2011/0009771 | A1 | 1/2011 | Guillon et al. | |
| 2012/0063620 | A1 | 3/2012 | Nomura et al. | |
| 2012/0201405 | A1* | 8/2012 | Slamka et al. | 381/307 |
| 2012/0328107 | A1* | 12/2012 | Nystrom et al. | 381/17 |
| 2013/0177166 | A1* | 7/2013 | Agevik et al. | 381/74 |
| 2015/0055783 | A1* | 2/2015 | Luo et al. | 381/17 |

FOREIGN PATENT DOCUMENTS

| | | | |
|---|---|---|---|
| EP | 2 611 216 | A1 | 7/2013 |
| JP | H0879900 | A | 3/1996 |
| JP | H08111899 | A | 4/1996 |
| JP | 2000-059893 | A | 2/2000 |

(Continued)

OTHER PUBLICATIONS

Second Technical Examination—Intention to Grant dated Jul. 14, 2014, for related Danish Patent Application No. PA 2013 70374, 2 pages.

(Continued)

*Primary Examiner* — David Ton
(74) *Attorney, Agent, or Firm* — Vista IP Law Group, LLP; Gerald Chan

(57) ABSTRACT

A method of determining a set of individual HRTFs for a specific human includes: obtaining a set of approximate HRTFs; obtaining at least one measured HRTF of the specific human; determining a deviation of one of the at least one measured HRTF with relation to a corresponding one of the set of approximate HRTFs; and forming the set of individual HRTFs by modification of the set of approximate HRTFs based at least in part on the determined deviation.

13 Claims, 4 Drawing Sheets

(56) References Cited

FOREIGN PATENT DOCUMENTS

| | | | |
|---|---|---|---|
| JP | 2002-223500 | A | 8/2002 |
| JP | 2003-230198 | A | 8/2003 |
| WO | 95/23493 | A1 | 8/1995 |
| WO | WO 98/06330 | | 2/1998 |
| WO | 2007/031905 | A1 | 3/2007 |
| WO | WO 2010/043223 | A1 | 4/2010 |
| WO | WO 2010/146857 | A1 | 12/2010 |
| WO | 2011/045751 | A1 | 4/2011 |
| WO | 2012/164346 | A1 | 12/2012 |

OTHER PUBLICATIONS

Extended European Search Report dated Dec. 3, 2013 for related EP Patent Application No. 13175052.3, 10 pages.

Bo-Sun Xie, "Recovery of individual head-related transfer functions from a small set of measurements", The Journal of the Acoustical Society of America, American Institute of Physics for the Acoustical Society of America, New York, NY, US, vol. 132, No. 1, Jul. 1, 2012, 13 pages.

V.R. Algazi, et al., "The CIPIC HRTF database", Application of Signal Processing to Audio and Acoustics, 2001 IEEE Workshop on the Oct. 21-24, 2001, IEEE, Oct. 21, 2001, 4 pages.

Lemaire V; Clerot F; Busson S; Nicol R; Choqueuse V; "Individualized HRTFs from few measurements: a statistical learning approach", Neural Networks, 2005. Proceedings. 2005 IEEE International Joint Conference on Montreal, Que., Canada Jul. 31-Aug. 4, 2005, vol. 4.

First Technical Examination and Search Report dated Jan. 28, 2014, for related Danish Patent Application No. PA 2013 70374, 4 pages.

Notification of Reasons for Rejection dated Nov. 18, 2014 for related Japanese Patent Application No. 2014-137176, 11 pages.

Kenji Ozawa, et al., "Influence of Individual Calibration for Binaural Reproduction with Headphones", Journal of Virtual Reality Society of Japan, Japan, The Virtual Reality Society of Japan, Sep. 30, 2000, 5 (3), pp. 949-956 (with English Abstract).

Kenji Watanabe, et al., "An Investigation on the Estimation of Interaural Time Difference Based on Anthropometric Parameters" Journal of Virtual Reality Society of Japan, Japan, The Virtual Reality Society of Japan, Dec. 31, 2005, 10 (4), pp. 609-617 (with English Abstract).

Kenji Watanabe, et al., "Effects of Individualization of Interaural Level Difference on Sound Localization", Research Paper by the Institute of Electronics, Information and Communication Engineers, EA, applied acoustics, Japan, The Institute of Electronics, Information and Communication Engineers, Aug. 2, 2006, 106 (204), pp. 29-34 (with English Abstract).

Shoji Shimada et al., "Out-of-Head Sound Image Localization Technologies with Headphone", Acoustical Science and Technology, Japan, The Acoustical Society of Japan, Jul. 1, 2005, 61 (7), pp. 392-397 (w/ English Translation).

Harvey Dillon, "Hearing Aid Handbook", Japan, Ishiyaku Publishers Inc., Oct. 15, 2004, pp. 359-361 (w/English Translation).

Japanese Notification of Reason for Rejection, mailing date Sep. 1, 2015 for corresponding Japanese Patent Application No. 2014-137176, 6 pages.

* cited by examiner

DETERMINATION OF INDIVIDUAL HRTFS

RELATED APPLICATION DATA

This application claims priority to and the benefit of Danish Patent Application No. PA 2013 70374, filed on Jul. 4, 2013, and European Patent Application No. 13175052.3, filed on Jul. 4, 2013. The entire disclosures of both of the above applications are expressly incorporated by reference herein.

FIELD OF TECHNOLOGY

A new method of determining individual HRTFs, a new fitting system configured to determine individual HRTFs according to the new method, and a hearing instrument, or a device supplying audio to the hearing instrument, with the individual HRTFs determined according to the new method, are provided.

BACKGROUND

Hearing aid users have been reported to have poorer ability to localize sound sources when wearing their hearing aids than without their hearing aids. This represents a serious problem for the hearing impaired population.

Furthermore, hearing aids typically reproduce sound in such a way that the user perceives sound sources to be localized inside the head. The sound is said to be internalized rather than being externalized. A common complaint of hearing aid users trying to understand speech in noise is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing aid with improved externalization and localization of sound sources.

A human with normal hearing will also experience benefits of improved externalization and localization of sound sources when using a hearing instrument, such as a headphone, headset, etc, e.g. playing computer games with moving virtual sound sources or otherwise enjoying replayed sound with externalized sound sources.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system would not be able to distinguish the reproduced sound from the actual sound generated by the spatial sound field itself.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The transmission of a sound wave from a sound source to the ears of the listener, wherein the sound source is positioned at a given direction and distance in relation to the left and right ears of the listener is described in terms of two transfer functions, one for the left ear and one for the right ear, that include any linear transformation, such as coloration, interaural time differences and interaural spectral differences. These transfer functions change with direction and distance of the sound source in relation to the ears of the listener. It is possible to measure the transfer functions for any direction and distance and simulate the transfer functions, e.g. electronically, e.g. with digital filters.

If a pair of filters are inserted in the signal path between a playback unit, such as a MP3-player, and headphones used by the listener, the pair of filters having transfer functions, one for the left ear and one for the right ear, of the transmission of a sound wave from a sound source positioned at a certain direction and distance in relation to the listener, to the positions of the headphones at the respective ears of the listener, the listener will achieve the perception that the sound generated by the headphones originates from a sound source, in the following denoted a "virtual sound source", positioned at the distance and in the direction in question, because of the true reproduction of the sound pressures at the eardrums in the ears.

The set of the two transfer functions, the one for the left ear and the one for the right ear, is called a Head-Related Transfer Function (HRTF). Each transfer function of the HRTF is defined as the ratio between a sound pressure p generated by a plane wave at a specific point in or close to the appertaining ear canal ($p_L$) in the left ear canal and $p_R$ in the right ear canal) in relation to a reference ($p_1$). The reference traditionally chosen is the sound pressure $p_l$ that would have been generated by a plane wave at a position right in the middle of the head, but with the listener absent. In the frequency domain, the HRTF is given by:

$$H_L=P_L/P_1,\ H_R=P_R/P_1$$

Where L designates the left ear and R designates the right ear, and P is the pressure level in the frequency domain.

The time domain representation or description of the HRTF, i.e. the inverse Fourier transforms of the HRTF, is designated the Head Related Impulse Response (HRIR). Thus, the time domain representation of the HRTF is a set of two impulse responses, one for the left ear and one for the right ear, each of which is the inverse Fourier transform of the corresponding transfer function of the set of two transfer functions of the HRTF in the frequency domain.

The HRTF contains all information relating to the sound transmission to the ears of the listener, including the geometries of a human being which are of influence to the sound transmission to the ears of the listener, e.g. due to diffraction around the head, reflections from shoulders, reflections in the ear canal, transmission characteristics through the ear canals, if the HRTF is determined for points inside the respective ear canals, etc. Since the anatomy of humans shows a substantial variability from one individual to the other, the HRTFs vary from individual to individual.

The complex shape of the ear is a major contributor to the individual spatial-spectral cues (ITD, ILD and spectral cues) of a listener.

In the following, one of the transfer functions of the HRTF, i.e. the left ear part of the HRTF or the right ear part of the HRTF, will also be termed the HRTF for convenience.

Likewise, the pair of transfer functions of a pair of filters simulating an HRTF is also denoted a Head-Related Transfer Function even though the pair of filters can only approximate an HRTF.

SUMMARY

Reproduction of sound to the ears of a listener in such a way that spatial information about positions of sound sources with relation to the listener is maintained has several positive effects, including externalization of sound sources, maintenance of sense of direction, synergy between the visual and auditory systems, and better understanding of speech in noise.

Preferably, measurement of individual HRTFs is performed with the individual standing in an anechoic chamber. Such measurements are expensive, time consuming, and cumbersome, and probably unacceptable to the user.

Therefore, approximated HRTFs are often used, such as HRTFs obtained by measurements with an artificial head, e.g. a KEMAR manikin. An artificial head is a model of a human head where geometries of a human being which influence the propagation of sound to the eardrums of a human, including diffraction around the body, shoulder, head, and ears, are modelled as closely as possible. During determination of HRTFs of the artificial head, two microphones are positioned in the ear canals of the artificial head to sense sound pressures, similar to the procedure for determination of HRTFs of a human.

However, when binaural signals have been generated using HRTFs from an artificial head, the actual listener's experience has been disappointing. In particular, listeners report internalization of sound sources and/or diffused sense of direction.

In general, sound sources positioned on the so-called "cone of confusion" with the same distance to the user, do not give rise to neither different ITDs nor different ILDs. Consequently, the listener cannot determine from the ITD or ILD, whether the sound sources are located behind, in front of, above, below, or anywhere else along a circumference of a cone at any given distance from the ear.

Thus, accurate individual HRTFs are required to convey the perception of sense of direction to the user.

Therefore there is a need for a method for generation of a set of individual HRTF's in a fast, inexpensive and reliable way.

Thus, a new method of determining a set of individual HRTFs for a human is provided, comprising the steps of:

obtaining a set of approximate HRTFs, obtaining at least one measured HRTF of the specific human, determining a deviation of one of the at least one measured HRTF with relation to a corresponding one of the set of approximate HRTFs, and forming the set of individual HRTFs by modification of the set of approximate HRTFs based at least in part on the determined deviation.

The approximate HRTFs may be HRTFs determined in any other way than measurement of the HRTFs of the human in question with microphones positioned at the ears of the human in question, e.g. at the entrance to the ear canal of the left ear and right ear.

For example, the approximate HRTFs may be HRTFs previously determined for an artificial head, such as a KEMAR manikin, and stored for subsequent use. The approximate HRTFs may for example be stored locally in a memory at the dispenser's office, or may be stored remotely on a server, e.g. in a database, for access through a network, such as a Wide-Area-Network, such as the Internet.

The approximate HRTFs may also be determined as an average of previously determined HRTFs for a group of humans. The group of humans may be selected to fit certain features of the human for which the individual HRTFs are to be determined in order to obtain approximate HRTFs that more closely match the respective corresponding individual HRTFs. For example, the group of humans may be selected according to age, race, gender, family, ear size, etc, either alone or in any combination.

The approximate HRTFs may also be HRTFs previously determined for the human in question, e.g. during a previous fitting session at an earlier age.

Throughout the present disclosure, HRTFs for the same combination of direction and distance, but obtained in different ways and/or for different humans and/or artificial heads, are termed corresponding HRTFs.

The deviation(s) of the one or more individual measured HRTF(s) with relation to the corresponding approximate HRTF(s) of the set of approximate HRTFs is/are determined by comparison in the time or frequency domain.

In the comparison, phase information may be disregarded. The ears of a human are not sensitive to the phase of sound signals. What is important is the relative phase or time difference of sound signals as received at the ears of the human and as long as the relative time or phase differences are not disturbed; the HRTFs may be modified disregarding timing or phase information.

In one embodiment of the new method, solely a single individual HRTF is measured, preferably a far field measurement in the forward looking direction is performed, i.e. 0° azimuth, 0° elevation.

When a listener resides in the far field of a sound source, the HRTFs do not change with distance. Typically, the listener resides in the far field of a sound source, when the distance to the sound source is larger than 1.5 m.

In many fitting sessions, the far field HRTF of one direction, typically the forward looking direction is already measured.

The individual HRTFs may then be obtained by modification of the corresponding approximate HRTFs in accordance with a deviation(s) of the measured individual HRTF(s) with relation to the corresponding approximate HRTF(s) as determined in the frequency domain or in the time domain.

In the frequency domain, a synthesizing filter H may be determined as the ratio between the measured individual HRTF and the corresponding approximate HRTF:

$$H=\mathrm{HRTF}_{individual}/\mathrm{HRTF}_{app}$$

Then, each of the individual HRTFs of the human may be determined by multiplication of the corresponding approximate HRTF with the synthesizing filter H:

$$\mathrm{HRTF}_{individual}(\theta, \phi, d)=H\cdot\mathrm{HRTF}_{app}(\theta, \phi, d)$$

Wherein θ is the azimuth, ϕ is the elevation, and d is the distance to the sound source position for which the individual HRTF is obtained.

Most often, HRTFs are determined for the far field only, i.e.

$$\mathrm{HRTF}_{individual}(\theta, \phi)=H\cdot\mathrm{HRTF}_{app}(\theta, \phi)$$

In the time domain, a synthesizing impulse response h may be determined as the de-convolution of the measured individual $h_{individual}$ with the corresponding approximate impulse response $h_{app}$, i.e. solve the equation:

$$h_{individual}=h*h_{app}$$

wherein * is the symbol for convolution of functions.

Then, each of the individual impulse responses $h_{individual}$ of the human may be determined by convolution of the corresponding approximate impulse responses $h_{app}$ with the synthesizing impulse response h:

$$h_{individual}(\theta, \phi, d)=h*h_{app}(\theta, \phi, d),$$

and in the far field:

$$h_{individual}(\theta, \phi)=h*h_{app}(\theta, \phi),$$

Wherein θ is the azimuth, ϕ is the elevation, and d is the distance to the sound source position for which the individual impulse response is obtained.

In order to make the individual HRTFs more accurate, HRTFs of a plurality of combinations of directions and distances may be determined during a fitting session of a hearing instrument, typically including the forward looking direction.

Remaining individual HRTFs may then be obtained by modification of the corresponding approximate HRTFs in accordance with deviation(s) in the frequency domain or in the time domain of the measured individual HRTF(s) with relation to the corresponding approximate HRTF(s).

In the frequency domain, for each measured individual $HRTF^d$, a synthesizing filter $H^d$ may be determined as the ratio between the measured individual $HRTF^d$ and the corresponding approximate $HRTF^d$:

$$H^d=\mathrm{HRTF}^d_{individual}/HRTF^d_{app},$$

And disregarding phase:

$$|H^d|=|\mathrm{HRTF}^d_{individual}|/|\mathrm{HRTF}^d_{app}|,$$

Then, for each of the remaining individual $HRTF^r$s of the human, a corresponding synthesizing filter $H^s$ may be determined by interpolation or extrapolation of the synthesizing filters $H^d$, and each of the remaining individual $HRTF^r$s of the human may be determined by multiplication of the corresponding approximate $HRTF^r$ with the synthesizing filter $H^s$:

$$\mathrm{HRTF}^r_{individual}(\theta, \phi, d)=H^s\cdot\mathrm{HRTF}^r_{app}(\theta, \phi, d).$$

Or $$|\mathrm{HRTF}^r_{individual}(\theta, \phi)|=|H^s|\cdot|\mathrm{HRTF}^r_{app}(\theta, \phi)|.$$

Wherein θ is the azimuth, ϕ is the elevation, and d is the distance to the sound source position for which the individual HRTF is obtained.

Likewise in the time domain, a synthesizing impulse response $h^d$ may be determined as the de-convolution of the measured individual $h^d_{individual}$ with the corresponding approximate impulse response $hd_{app}$, i.e. solve the equation:

$$h^d_{individual}=h^d*h^d_{app}$$

wherein * is the symbol for convolution of functions.

Then, for each of the remaining individual impulse responses $h^r_{individual}$ of the human, a corresponding synthesizing impulse response $h^s$ may be determined by interpolation or extrapolation of the synthesizing impulse responses $h^d$, and each of the remaining individual impulse responses $h^r$ of the human may be determined by multiplication of the corresponding approximate impulse responses $h^r_{app}$ with the synthesizing impulse response $h^s$:

$$h^r_{individual}(\theta, \phi, d)=h^s*h^r_{app}(\theta, \phi, d), \text{ and}$$

in the far field:

$$h^r_{individual}(\theta, \phi)=h^s*h^r_{app}(\theta, \phi),$$

wherein θ is the azimuth, ϕ is the elevation, and d is the distance to the sound source position for which the individual impulse response is obtained.

Thus, according to the new method a large number of individual HRTFs may be provided without individual measurement of each of the individual HRTFs; rather measurement of a single or a few individual HRTFs is sufficient so that the set of individual HRTFs can be provided without discomfort to the intended user of the hearing instrument.

A hearing instrument is also provided, comprising an input for provision of an audio input signal representing sound output by a sound source, and a binaural filter for filtering the audio input signal and configured to output a right ear signal for a right ear of a user of the hearing instrument and a left ear signal for a left ear of the user, wherein the binaural filter comprises an individual HRTF, which is one of the individual HRTFs determined in accordance with the method of the present disclosure.

The hearing instrument provides the user with improved sense of direction.

The hearing instrument may be a headset, a headphone, an earphone, an ear defender, an earmuff, etc, e.g. of the following types: Ear-Hook, In-Ear, On-Ear, Over-the-Ear, Behind-the-Neck, Helmet, Headguard, etc.

Further, the hearing instrument may be a hearing aid, e.g. a binaural hearing aid, such as a BTE, a RIE, an ITE, an ITC, a CIC, etc, (binaural) hearing aid.

The audio input signal may originate from a sound source, such as a monaural signal received from a spouse microphone, a media player, a hearing loop system, a teleconference system, a radio, a TV, a telephone, a device with an alarm, etc., The audio input signal is filtered with the binaural filter in such a way that the user perceives the received audio signal to be emitted by the sound source positioned in a position and/or arriving from a direction in space corresponding to the HRTF of the binaural filter.

The hearing instrument may be interconnected with a device, such as a hand-held device, such as a smart phone, e.g. an Iphone, an Android phone, a windows phone, etc.

The hearing instrument may comprise a data interface for transmission of data to the device.

The data interface may be a wired interface, e.g. a USB interface, or a wireless interface, such as a Bluetooth interface, e.g. a Bluetooth Low Energy interface.

The hearing instrument may comprise an audio interface for reception of an audio signal from the device and for provision of the audio input signal.

The audio interface may be a wired interface or a wireless interface.

The data interface and the audio interface may be combined into a single interface, e.g. a USB interface, a Bluetooth interface, etc.

The hearing instrument may for example have a Bluetooth Low Energy data interface for exchange of control data between the hearing instrument and the device, and a wired audio interface for exchange of audio signals between the hearing instrument and the device.

The device may comprise a sound generator connected for outputting audio signals to the hearing instrument via pairs of filters with the determined individual HRTFs for generation of a binaural acoustic sound signal emitted towards the eardrums of the user. In this way, the user of the hearing instrument will perceive sound output by the device to originate from a virtual sound source positioned outside the user's head in a position corresponding to the selected HRTF simulated by the pair of filters.

The hearing instrument may comprise an ambient microphone for receiving ambient sound for transmission towards the ears of the user. This is obviously the case for hearing aids, but other types of hearing instruments may also comprise an ambient microphone, for example in the event that the hearing instrument provides a sound proof, or substantially, sound proof, transmission path for sound emitted by the loudspeaker(s) of the hearing instrument towards the ear(s) of the user, the user may be acoustically disconnected in an undesirable way from the surroundings. This may for example be dangerous when moving in traffic.

The hearing instrument may have a user interface, e.g. a push button, so that the user can switch the microphone on and off as desired thereby connecting or disconnecting the ambient microphone and one loudspeaker of the hearing instrument.

The hearing instrument may have a mixer with an input connected to an output of the ambient microphone and another input connected to an output of the device supplying an audio signal, and an output providing an audio signal that is a weighted combination of the two input audio signals.

The user input may further include means for user adjustment of the weights of the combination of the two input audio signals, such as a dial, or a push button for incremental adjustment.

The hearing instrument may have a threshold detector for determining the loudness of the ambient signal received by the ambient microphone, and the mixer may be configured for including the output of the ambient microphone signal in its output signal only when a certain threshold is exceeded by the loudness of the ambient signal.

A fitting instrument for fitting a hearing aid to a user and operating in accordance with the new method for provision of individual HRTFs of the user to the hearing aid, is also provided.

Fitting instruments are well known in the art and have proven adequate for adjusting signal processing parameters of a hearing aid so that the hearing aid accurately compensates the actual hearing loss of the hearing aid user.

The fitting process typically involves measuring the auditory characteristics of the hearing aid user's hearing, estimating the acoustic characteristics needed to compensate for the particular auditory deficiency measured, adjusting the auditory characteristics of the acoustic hearing aid so that the appropriate acoustic characteristics may be delivered, and verifying that these particular auditory characteristics do compensate for the hearing deficiency found by operating the acoustic hearing aid in conjunction with the user.

Standard techniques are known for these fittings which are typically performed by an audiologist, hearing aid dispenser, otologist, otolaryngologist, or other doctor or medical specialist.

In the well-known methods of acoustically fitting a hearing aid to an individual, the threshold of the individual's hearing is typically measured using an audiometer, i.e. a calibrated sound stimulus producing device and calibrated headphones. The measurement of the threshold of hearing takes place in a room with very little audible noise.

Generally, the audiometer generates pure tones at various frequencies between 125 Hz and 8,000 Hz. These tones are transmitted to the individual being tested, e.g. through headphones of the audiometer. Normally, the tones are presented in step of an octave or half an octave. The intensity or volume of the pure tones is varied and reduced until the individual can just barely detect the presence of the tone. This intensity threshold is often defined and found as the intensity of which the individual can detect 50 percent of the tones presented. For each pure tone, this intensity threshold is known as the individual's air conduction threshold of hearing. Although the threshold of hearing is only one element among several that characterizes an individual's hearing loss, it is the predominant measure traditionally used to acoustically fit a hearing aid.

Once the threshold of hearing in each frequency band has been determined, this threshold is used to estimate the amount of amplification, compression, and/or other adjustment that will be employed to compensate for the individual's loss of hearing. The implementation of the amplification, compression, and/or other adjustments and the hearing compensation achieved thereby depends upon the hearing aid being employed. There are various formulas known in the art which have been used to estimate the acoustic parameters based upon the observed threshold of hearing. These include generic rules, such as NAL and POGO, which may be used when fitting hearing aid from most hearing aid manufactures. There are also various proprietary methods used by various hearing aid manufacturers. Additionally, based upon the experience of the person performing the testing and the fitting of the hearing aid to the individual, these various formulas may be adjusted.

The new fitting instrument has a processor that is further configured for determining individual HRTFs of a user of the hearing aid to be fitted, by obtaining approximate HRTFs, e.g. from a server accessed through the Internet.

The processor is also configured for controlling measurement of one or more individual HRTF(s) of the user, e.g. the HRTF of the forward looking direction with azimuth $\theta=0°$ and elevation $\phi=0°$.

The processor is further configured for determination of individual HRTFs or HRIRs by determination of deviation(s) of the measured one or more individual HRTF(s) or HRIR(s) with relation to the corresponding approximated HRTF(s) or HRIR(s), respectively, and subsequent determination of other HRTFs or HRIRs based on the corresponding approximate HTRFs or HRIRs and the determined deviation(s).

Signal processing in the new hearing aid and in the new fitting instrument may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A method of determining a set of individual HRTFs for a specific human includes: obtaining a set of approximate HRTFs; obtaining at least one measured HRTF of the specific human; determining a deviation of one of the at least one measured HRTF with relation to a corresponding one of the set of approximate HRTFs; and forming the set of individual HRTFs by modification of the set of approximate HRTFs based at least in part on the determined deviation.

Optionally, the at least one measured HRTF comprises only a single measured HRTF.

Optionally, the act of obtaining the set of approximate HRTFs includes determining the approximate HRTFs for an artificial head.

Optionally, the act of obtaining the set of approximate HRTFs includes retrieving the approximate HRTFs from a database.

Optionally, the method further includes: classifying the specific human into a predetermined group of humans; and retrieving the approximate HRTFs from a database with HRTFs relating to the predetermined group of humans, such as average HRTFs of the predetermined group of humans, or previously measured HRTFs of one or more humans representing the predetermined group of humans.

Optionally, the act of modifying includes: calculating ratio(s) between the at least one measured HRTF and the corresponding approximate HRTF(s), and forming the set of individual HRTFs by modification of the set of approximate HRTFs in accordance with the calculated ratio(s).

Optionally, the at least one measured HRTF comprises a plurality of measured HRTFs; the method further comprises determining additional deviation(s) of other one(s) of the measured HRTFs with relation to corresponding one(s) of the set of approximate HRTFs; and the act of forming the set of individual HRTFs comprises modifying the set of approximate HRTFs based at least in part on the determined deviation and the determined additional deviation(s).

A fitting instrument for fitting a hearing aid to a user includes a processor configured for retrieving a set of approximate HRTFs from a memory of the fitting instrument or a remote server; obtaining at least one measured HRTF of the user; determining a deviation of one of the at least one measured HRTF with relation to a corresponding one of the set of approximate HRTFs; and forming a set of individual HRTFs by modification of the set of approximate HRTFs based at least in part on the determined deviation.

A hearing instrument includes: an input for provision of an audio input signal representing sound output by a sound source; and a binaural filter for filtering the audio input signal, and configured to output a right ear signal for a right ear of a user of the hearing instrument and a left ear signal for a left ear of the user; wherein the binaural filter comprises an individual HRTF, which is one of the individual HRTFs determined in a accordance with one or more of the methods described herein.

Optionally, the hearing instrument is a binaural hearing aid.

A device includes: a sound generator; and a binaural filter for filtering an audio output signal of the sound generator into a right ear signal for a right ear of a user of the device and a left ear signal for a left ear of the user; wherein the binaural filter comprises an individual HRTF, which is one of the individual HRTFs determined in a accordance with one or more of the methods described herein.

Other and further aspects and features will be evident from reading the following detailed description.

BRIEF DESCRIPTION OF THE DRAWINGS

The drawings illustrate the design and utility of embodiments, in which similar elements are referred to by common reference numerals. These drawings may or may not be drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
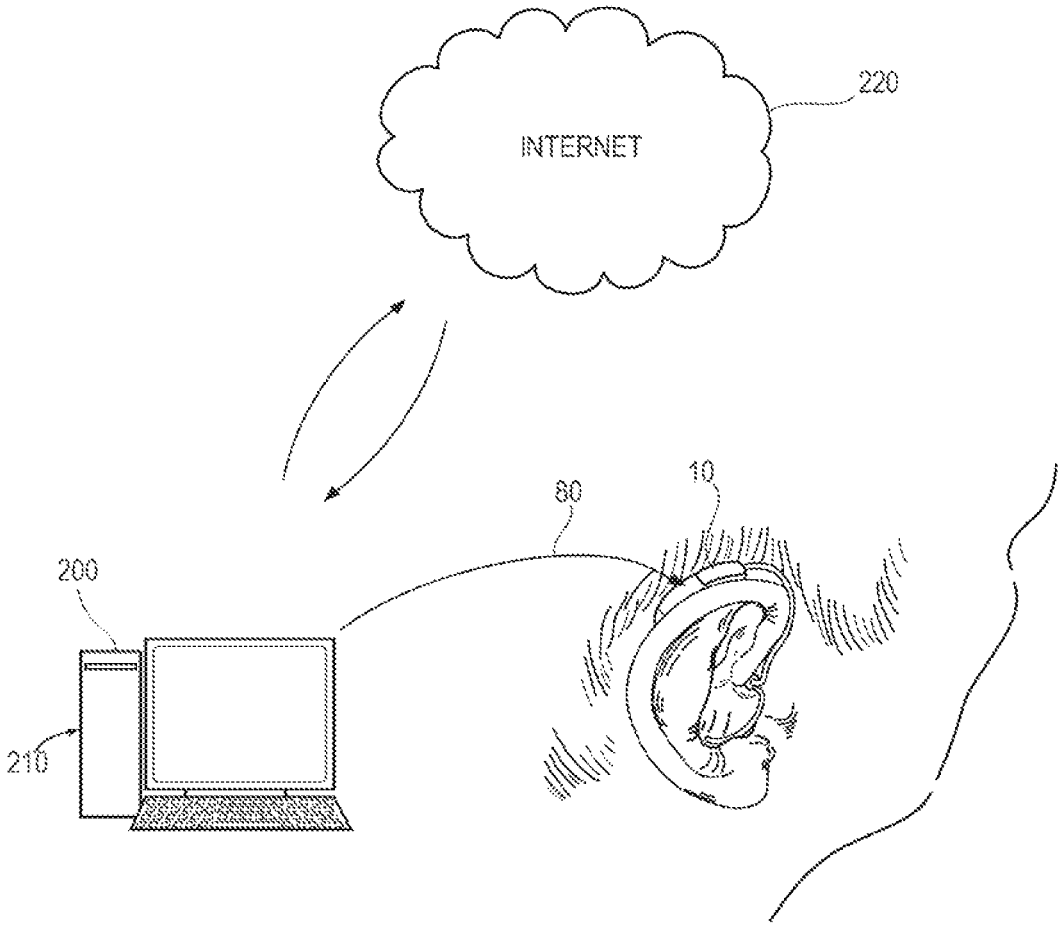
FIG. 1 schematically illustrates a new fitting instrument.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method, fitting instrument, hearing instrument, and device supplying audio to the hearing instrument, will now be described more fully hereinafter with reference to the accompanying drawings, in which various examples of the new method, fitting instrument, hearing instrument, and device supplying audio to the hearing instrument, are illustrated. The new method, fitting instrument, hearing instrument, and device supplying audio to the hearing instrument, according to the appended claims may, however, be embodied in different forms and should not be construed as limited to the examples set forth herein. Rather, these examples are provided so that this disclosure will be thorough and complete, and will fully convey the scope of the appended claims to those skilled in the art.

It should be noted that the accompanying drawings are schematic and simplified for clarity, and they merely show details which are essential to the understanding of the new method and fitting instrument, while other details have been left out.

Like reference numerals refer to like elements throughout. Like elements will, thus, not be described in detail with respect to the description of each figure.

FIG. 1 schematically illustrates a new fitting instrument 200 and its interconnections with the Internet 220 and a new BTE hearing aid 10 shown in its operating position with the BTE housing behind the ear, i.e. behind the pinna, of a user.

The fitting instrument 200 has a processor 210 that is configured for determining individual HRTFs of a user of the hearing aid 10 to be fitted, by obtaining approximate HRTFs , e.g. from a server (not shown) accessed through the Internet 220.

The processor 210 is also configured for controlling measurement of one or more individual HRTF(s) of the user, e.g. the HRTF of the forward looking direction with azimuth $\theta=0°$ and elevation $\phi=0°$.

The processor 210 is further configured for determination of individual HRTFs or HRIRs by determination of deviation(s) of the measured one or more individual HRTF(s) or HRIR(s) with relation to the corresponding approximated HRTF(s) or HRIR(s), respectively, and subsequent determination of other HRTFs or HRIRs based on the corresponding approximate HTRFs or HRIRs and the determined deviation(s).

The fitting instrument 200 is further configured for transmission of some or all of the determined individual HRTFs and/or HRIRs to the hearing aid through a wireless interface 80.

The fitting instrument 200 may further be configured for storing some or all of the determined individual HRTFs and/or HRIRs on a remote server accessed through the Internet for subsequent retrieval, e.g. by the hand-held device, such as a smartphone.

The BTE hearing aid 10 has at least one BTE sound input transducer with a front microphone 82A and a rear microphone 84A for conversion of a sound signal into a microphone audio sound signal, optional pre-filters (not shown) for filtering the respective microphone audio sound signals, A/D converters (not shown) for conversion of the respective microphone audio sound signals into respective digital microphone audio sound signals 86, 88 that are input to a processor 90 configured to generate a hearing loss compensated output signal 92 based on the input digital audio sound signals 86, 88.

The illustrated BTE hearing aid further has a memory for storage of right ear parts of individual HRIRs of the user determined by the fitting instrument and transmitted to the hearing aid. The processor is further configured for selection of a right ear part of a HRIR for convolution with an audio sound signal input to the processor so that the user perceives the audio sound signal to arrive from a virtual sound source position at a distance and in a direction corresponding to the selected HRIR, provided that similar processing takes place at the left ear.

Figure 2:
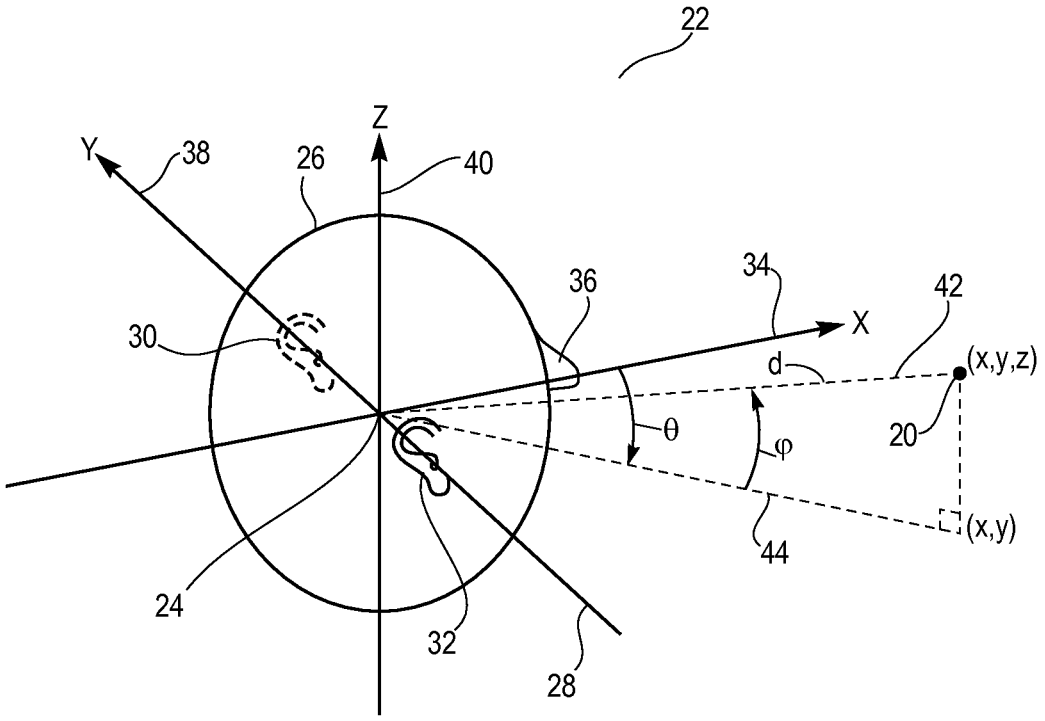
FIG. 2 shows a virtual sound source positioned in a head reference coordinate system, FIG. 3 schematically illustrates a device with individual HRTFs interconnected with a binaural hearing aid.

FIG. 2 shows a virtual sound source 20 positioned in a head reference coordinate system 22 that is defined with its centre 24 located at the centre of the user's head 26, which is defined as the midpoint 24 of a line 28 drawn between the respective centres of the eardrums (not shown) of the left and right ears 30, 32 of the user. The x-axis 34 of the head reference coordinate system 22 is pointing ahead through a centre of the nose 36 of the user, its y-axis 38 is pointing towards the left ear 33 through the centre of the left eardrum (not shown), and its z-axis 40 is pointing upwards. A line 42 is drawn through the centre 24 of the coordinate system 22 and the virtual sound source 20 and projected onto the XY-plane as line 44.

Azimuth θ is the angle between line 44 and the X-axis 34. The X-axis 34 also indicates the forward looking direction of the user. Azimuth θ is positive for negative values of the y-coordinate of the virtual sound source 20, and azimuth θ is negative for positive values of the y-coordinate of the virtual sound source 20.

Elevation ϕ is the angle between line 42 and the XY-plane. Elevation ϕ is positive for positive values of the z-coordinate of the virtual sound source 20, and elevation ϕ is negative for negative values of the z-coordinate of the virtual sound source 20.

Distance d is the distance between the virtual sound source 20 and the centre 24 of the user's head 26.

The illustrated new fitting instrument 200 is configured for measurement of individual HRTFs by measurement of sound pressures at the closed entrances to the left and right ear canals, respectively, of the user.

WO 95/23493 A1 discloses determination of HRTFs and HRIRs that constitute good approximations to individual HRTFs of a number of humans. The HRTFs and HRIRs are determined at the entrances to the ear closed canals; see FIGS. 5 and 6 of WO 95/23493 A1. Examples of individual HRTFs and HRIRs for various values of azimuth θ and elevation ϕ are shown in FIG. 1 of WO 95/23493 A1.

The illustrated fitting instrument 200 has a processor that is configured for determining individual HRTFs of a user of the hearing aid 10 to be fitted, by accessing a remote server (not shown) through the Internet 220 to retrieve approximate HRTFs stored on a memory of the server and e.g. obtained as disclosed in WO 95/23493 A1, however with 2° intervals.

The processor is also configured for controlling measurement of a single HRTF of the user, namely the HRTF of the forward looking direction with azimuth θ=0° and elevation ϕ=0°. The processor is configured for determination of the corresponding impulse response $h^d_{individual}$. The determined $h^d_{individual}$ is compared to the corresponding approximate impulse response $h^d_{app}$. A synthesizing impulse response $h^d$ is then determined as the de-convolution of the measured individual impulse response $h^d_{individual}$ with the corresponding approximate impulse response $hd_{app}$, i.e. solve the equation:

$$h^d_{individual}=h^d*h^d_{app}$$

wherein * is the symbol for convolution of functions.

Then, for each of the remaining individual impulse responses $h^r_{individual}$ of the human, the synthesizing impulse response $h^d$ may be used for determination of the remaining individual impulse responses $h^r_{individual}$ of the human may be determined by convolution of the corresponding approximate impulse responses $h^r_{app}$ with the synthesizing impulse response $h^d$:

$$h^r_{individual}(\theta, \phi, d)=h^d*h^r_{app}(\theta, \phi, d),$$

wherein θ is the azimuth, ϕ is the elevation, and d is the distance to the sound source position for which the individual impulse response is obtained as illustrated in FIG. 2.

Thus, according to the new method a large number of individual HRTFs is provided without individual measurement of each of the individual HRTFs; rather measurement of a single or a few individual HRTFs is sufficient so that the set of individual HRTFs can be provided without discomfort to the intended user of the hearing aid.

In this way, provision of a hearing aid that provides the user with improved sense of direction, is facilitated.

Figure 3:
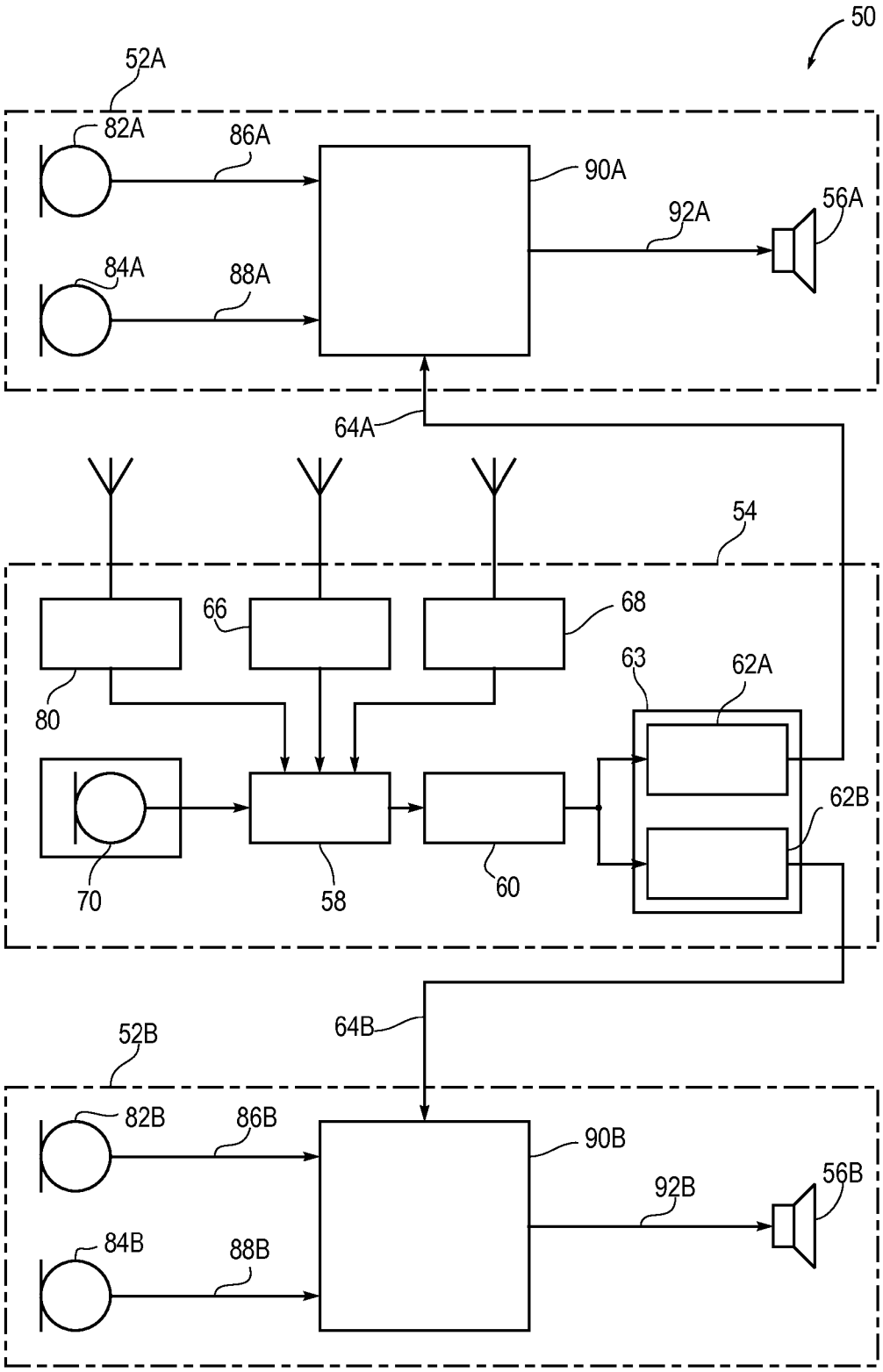

FIG. 3 shows a hearing system 50 with a binaural hearing aid 52A, 52B and a hand-held device 54. The illustrated hearing system 50 uses speech syntheses to issue messages and instructions to the user and speech recognition is used to receive spoken commands from the user.

The illustrated hearing system 50 comprises a binaural hearing aid 52A, 52B comprising electronic components including two receivers 56A, 56B for emission of sound towards the ears of the user (not shown), when the binaural hearing aid 52A, 52B is worn by the user in its intended operational position on the user's head. It should be noted that the binaural hearing aid 52A, 52B shown in FIG. 3, may be substituted with another hearing instrument of any known type including an Ear-Hook, In-Ear, On-Ear, Over-the-Ear, Behind-the-Neck, Helmet, Headguard, etc, headset, headphone, earphone, ear defenders, earmuffs, etc.

The illustrated binaural hearing aid 52A, 52B may be of any type of hearing aid, such as a BTE, a RIE, an ITE, an ITC, a CIC, etc, binaural hearing aid. The illustrated binaural hearing aid may also be substituted by a single monaural hearing aid worn at one of the ears of the user, in which case sound at the other ear will be natural sound inherently containing the characteristics of the user's individual HRTFs.

The illustrated binaural hearing aid 52A, 52B has a user interface (not shown), e.g. with push buttons and dials as is well-known from conventional hearing aids, for user control and adjustment of the binaural hearing aid 52A, 52B and possibly the hand-held device 54 interconnected with the binaural hearing aid 52A, 52B, e.g. for selection of media to be played back.

In addition, the microphones of binaural hearing aid 52A, 52B may be used for reception of spoken commands by the user transmitted (not shown) to the hand-held device 54 for speech recognition in a processor 58 of the hand-held device 54, i.e. decoding of the spoken commands, and for controlling the hearing system 50 to perform actions defined by respective spoken commands.

The hand-held device 54 filters the output of a sound generator 60 of the hand-held device 54 with a binaural filter 63, i.e. a pair of filters 62A, 62B, with a selected HRTF into two output audio signals, one for the left ear and one for the right ear, corresponding to the filtering of the HRTF of a selected direction. This filtering process causes sound reproduced by the binaural hearing aid 50 to be perceived by the user as coming from a virtual sound source localized outside the head from a direction corresponding to the HRTF in question.

The sound generator 60 may output audio signals representing any type of sound suitable for this purpose, such as speech, e.g. from an audio book, radio, etc, music, tone sequences, etc.

The user may for example decide to listen to a radio station while walking, and the sound generator 60 generates audio signals reproducing the signals originating from the desired radio station filtered by binaural filter 63, i.e. filter pair 62A, 62B, with the HRTFs in question, so that the user perceives to hear the desired music from the direction corresponding to the selected HRTFs.

The illustrated hand-held device 54 may be a smartphone with a GPS-unit 66 and a mobile telephone interface 68 and a WiFi interface 80.

Figure 4:
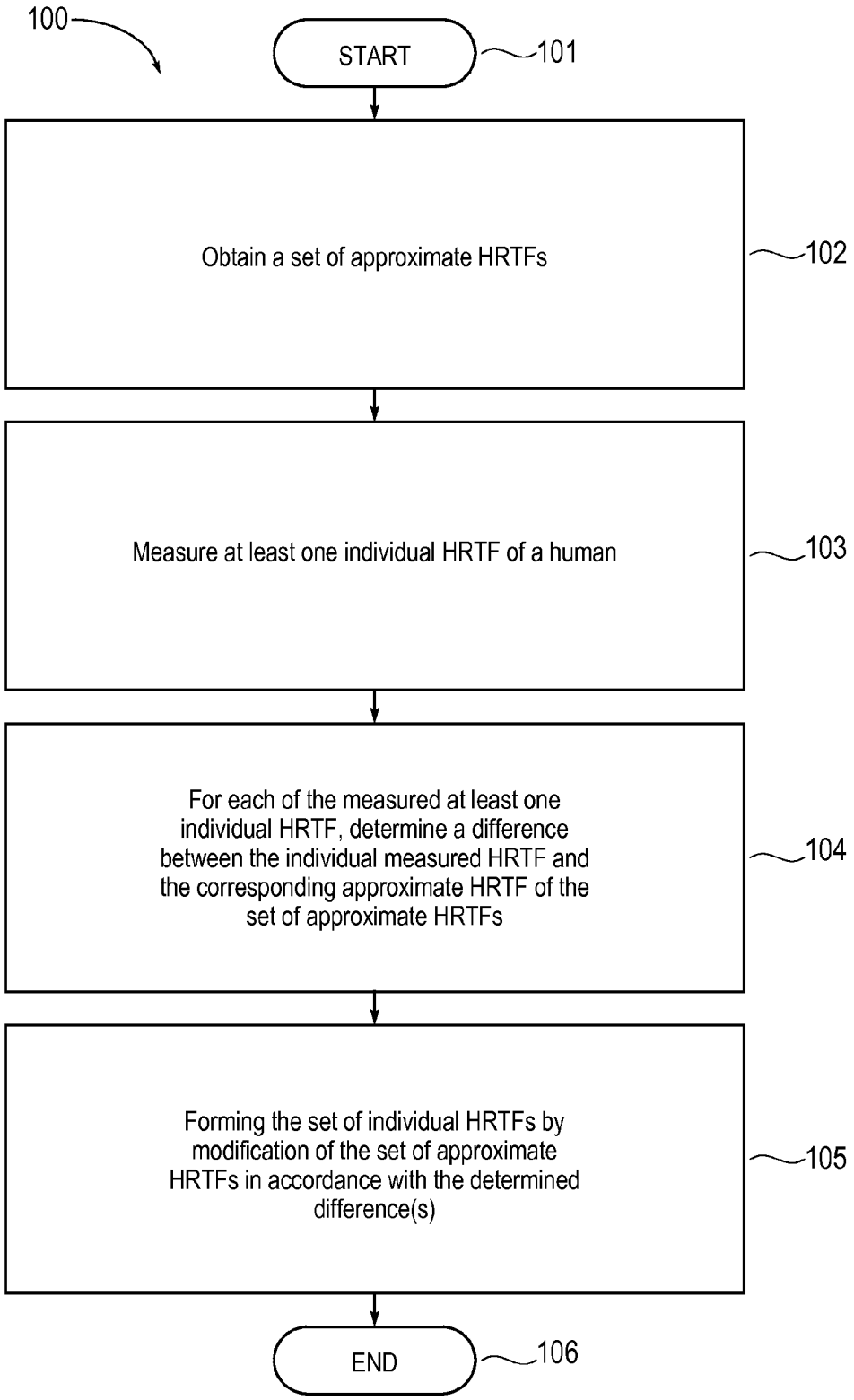
FIG. 4 is a flowchart of the new method.

FIG. 4 is a flowchart of the new method comprising the steps of:

102: Obtaining a set of approximate HRTFs,

103: Measure one or more individual HRTF(s) of the human,

104: For each of the one or more measured individual HRTFs, determine a deviation of the measured individual HRTF with relation to the corresponding approximate HRTF of the set of approximate HRTFs, and

105: Forming the set of individual HRTFs by modification of the set of approximate HRTFs in accordance with the determined deviation(s), as explained in more detail in the summary.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A method of determining a set of individual head-related transfer-functions (HRTFs) for a specific human, comprising:

obtaining a set of approximate HRTFs;

obtaining at least one measured HRTF of the specific human;

determining a parameter based on one of the at least one measured HRTF, and a corresponding approximate HRTF from the set of approximate HRTFs, wherein the act of determining the parameter comprises determining a synthesizing filter or an impulse response; and forming the set of individual HRTFs for the specific human by modification of the set of approximate HRTFs based at least in part on the determined parameter;

wherein the at least on measured HRTF is provisioned based on microphone signals from microphones.

2. The method according to claim 1, wherein the at least one measured HRTF comprises only a single measured HRTF.

3. The method according to claim 1, wherein the act of obtaining the set of approximate HRTFs includes determining the approximate HRTFs for an artificial head.

4. The method according to claim 1, wherein the act of obtaining the set of approximate HRTFs includes retrieving the approximate HRTFs from a database.

5. The method according to claim 1, further comprising:

classifying the specific human into a predetermined group of humans; and retrieving the approximate HRTFs from a database with HRTFs relating to the predetermined group of humans.

6. The method according to claim 1, wherein the act of determining the synthesizing filter includes: calculating a ratio between the at least one measured HRTF and the corresponding approximate HRTF; and wherein the act of forming the set of individual HRTFs comprises performing a multiplication using the set of approximate HRTFs and the calculated ratio.

7. The method according to claim 1, wherein:

the at least one measured HRTF comprises a plurality of measured HRTFs;

the method further comprises determining additional of parameter(s) based on other one(s) of the measured HRTFs, and corresponding one(s) of the set of approximate HRTFs; and the act of forming the set of individual HRTFs comprises modifying the set of approximate HRTFs based at least in part on the determined parameter and the determined additional parameter(s).

8. The method according to claim 1, wherein the act of obtaining the at least one measured HRTF of the specific human comprises using the microphones to pick up sound(s) applied from a direction with respect to the specific human.

9. A fitting instrument for fitting a hearing aid to a user, comprising:

an input configured to receive a set of approximate head-related-transfer-functions (HRTFs) stored in a memory device; and a processor configured for obtaining at least one measured HRTF of the user;

determining a parameter based on one of the at least one measured HRTF, and a corresponding approximate HRTF from the set of approximate HRTFs wherein the parameter comprises a synthesizing filter or an impulse response; and forming a set of individual HRTFs for the user by modification of the set of approximate HRTFs based at least in part on the determined parameter;

wherein the processor comprises an input for obtaining the at least one measured HRTF, the at least one measured HRTF being provisioned based on microphone signals from microphones.

10. The fitting instrument of claim 9, wherein the processor is configured to obtain the at least one measured HRTF of the user by receiving microphone signals representing sound(s) picked up by microphones.

11. A hearing instrument comprising:

an input for provision of an audio input signal representing sound output by a sound source; and a binaural filter for filtering the audio input signal, and configured to output a right ear signal for a right ear of a user of the hearing instrument and a left ear signal for a left ear of the user;

wherein the binaural filter comprises an individual HRTF, which is one of the individual HRTFs determined in accordance with the method of any of claims 1-7.

12. The hearing instrument according to claim 11, wherein the hearing instrument is a binaural hearing aid.

13. A device comprising:

a sound generator; and a binaural filter for filtering an audio output signal of the sound generator into a right ear signal for a right ear of a user of the device and a left ear signal for a left ear of the user;

wherein the binaural filter comprises an individual HRTF, which is one of the individual HRTFs determined in accordance with the method of any of claims 1-7.

* * * * *